US008371472B2

(12) United States Patent
Skopis

(10) Patent No.: US 8,371,472 B2
(45) Date of Patent: Feb. 12, 2013

(54) FREESTANDING CUP HOLDER

(76) Inventor: John Skopis, Glenview, IL (US)

( * ) Notice: Subject to any disclaimer, the term of this patent is extended or adjusted under 35 U.S.C. 154(b) by 0 days.

(21) Appl. No.: 12/907,961

(22) Filed: Oct. 19, 2010

(65) Prior Publication Data

US 2012/0091155 A1 Apr. 19, 2012

(51) Int. Cl.

| | |
|---|---|
| ***A47G 19/00*** | (2006.01) |
| ***B65D 21/02*** | (2006.01) |
| ***B65D 25/00*** | (2006.01) |
| ***B65D 1/24*** | (2006.01) |
| ***B65D 1/36*** | (2006.01) |
| ***B65D 25/04*** | (2006.01) |
| ***B65D 57/00*** | (2006.01) |
| ***B65D 85/00*** | (2006.01) |

(52) U.S. Cl. ..... 220/737; 220/738; 220/23.86; 220/513; 220/516

(58) Field of Classification Search ..... 220/738, 220/737, 23.86, 23.83, 513, 516
See application file for complete search history.

(56) References Cited

U.S. PATENT DOCUMENTS

| | | | | |
|---|---|---|---|---|
| 4,823,958 | A * | 4/1989 | Mahmud | 206/561 |
| 4,969,618 | A * | 11/1990 | Thompson | 248/152 |
| 5,720,516 | A * | 2/1998 | Young | 297/188.18 |
| 6,109,580 | A * | 8/2000 | Stern et al. | 248/311.2 |
| 6,520,366 | B1 * | 2/2003 | Bradley et al. | 220/23.2 |
| 2010/0089901 | A1 * | 4/2010 | Montana | 219/385 |

* cited by examiner

*Primary Examiner* — Anthony Stashick
*Assistant Examiner* — Andrew T Kirsch
(74) *Attorney, Agent, or Firm* — Joseph Stecewycz

(57) ABSTRACT

A freestanding cup holder is disclosed comprising a primary cylinder for holding a cup, the primary cylinder wrapped in one of a memory foam or a rubber material; one or more secondary cylinders each capable of holding a cup; and a connecting member connecting the primary cylinder to one or more of the secondary cylinders.

5 Claims, 2 Drawing Sheets

FREESTANDING CUP HOLDER

BACKGROUND OF THE INVENTION

1. Field of the Invention

The "freestanding cup holder," herein referred to as "the invention," and "present invention," is a device for holding beverage containers, and cups. More specifically, the invention acts as a beverage holder extension, an attachment to an existing cup holder, providing at least one additional cup holder.

2. Description of the Prior Art

Existing cup holders are prevalent in stadiums, arenas, theaters, concert halls, vehicles, and many other places. Existing cup holders are typically mounted between seats, or on the rear of each seat. Existing cup holders are limited in that they are capable of holding only a single cup at a time. The cost associated with installing two or more fixed cup holders per seat is fiscally unfeasible, despite the benefit of allowing storage for more than one beverage at a time. It is not uncommon for each person to purchase two or more beverages during a sporting event, or other event, to avoid having to frequently return to the concession area.

U.S. Pat. No. 5,234,251 describes a cup holder which can be mounted on the arm or standard of a seat, and in particular to a combination container holder and armrest in which the armrest can be removed and replaced.

U.S. Pat. No. 5,421,638 teaches a seat attachment which can be mounted on the standard of a seat in a manner that prevents the container holder from protruding into the aisle behind the seat.

U.S. Pat. No. 5,813,644 refers to a beverage cup holder for attachment to one or more seat backs or seat standards. The beverage cup holder includes an open top receptacle portion and a support portion. The support portion is secured to the seat backs. The open top receptacle is adapted for being attached to the support portion in an easily removable and replaceable fashion.

U.S. Pat. No. 5,938,091 teaches a cupholder that is mountable on a shopping cart for convenience of a user. The cupholder includes not only a receptacle for receiving a drink cup or container, but also receptacles for coupons, wallets, pencils and pens, etc.

However, none of the above provides the facility of holding more than one cup at a time using an existing cupholder.

In the light of the foregoing discussion, there is a need for a cup holder capable of holding more than one cup at a time. The cupholder must be able to mountable on or inside an existing, permanent cup holder, without requiring any modification to the existing cup holder.

SUMMARY OF THE INVENTION

An objective of the present invention is to provide a free standing cup holder.

An objective of the present invention is to provide a cup holder for holding a plurality of beverage cups.

In accordance with an embodiment of the present invention, the present invention provides a freestanding cup holder for holding a plurality of cups. The freestanding cup holder is attached to a permanent cup holder. The permanent cup holder is a fixed cup holder with a base. The freestanding cup holder includes a primary cylinder, one or more secondary cylinders and a connecting member. The primary cylinder holds a cup and is attached to the permanent cup holder. Each of the one or more secondary cylinders capable of holding a cup. The connecting member connects the primary cylinder to the one or more secondary cylinders. The primary cylinder and each of the one or more secondary cylinders is capable of holding a cup.

In accordance with another embodiment of the present invention, the present invention provides a free standing cup holder for holding a plurality of cups. The freestanding cup holder is capable of being attached to a permanent cup holder. The permanent cup holder is a fixed cup holder with a base. The freestanding cup holder includes a connecting member, a primary cylinder and one or more secondary cylinders. The connecting member includes a primary circular section and one or more secondary circular sections. The primary circular section is connected to the one or more secondary circular sections. The primary cylinder is attached to the permanent cup holder. Further, the primary circular section molded, or otherwise bonded, to the primary cylinder. Each of the one or more secondary circular sections being molded or otherwise bonded, to a corresponding secondary cylinder of the one or more secondary cylinders. The primary cylinder and each of the one or more secondary cylinders is capable of holding a cup.

In accordance with yet another embodiment of the present invention, the present invention provides a free standing cup holder for holding two cups. The freestanding cup holder is capable of being attached to a permanent cup holder. The permanent cup holder is a fixed cup holder with a base. The freestanding cup holder includes a first cylinder, a second cylinder, and a connecting member. The first cylinder is capable of being attached to the permanent cup holder and holds a first cup. The second cylinder is capable of holding a second cup. The connecting member connects the first cylinder to the second cylinder.

The freestanding cup holder as described in the present invention possesses a number of advantages. The device of the present invention facilitates holding of more than one cup using a single cup holder. The freestanding cup holder of the present invention uses an existing cup holder and full beverage to provide storage for more than two cups without the requirement of a fixed base. Further, the freestanding cup holder does not require a clamp, bracket, or other fixture for stability.

BRIEF DESCRIPTION OF THE DRAWINGS

For a more complete understanding of the present invention, the needs satisfied thereby, and the objects, features, and advantages thereof, reference now is made to the following description taken in connection with the accompanying drawings.

Figure 1:
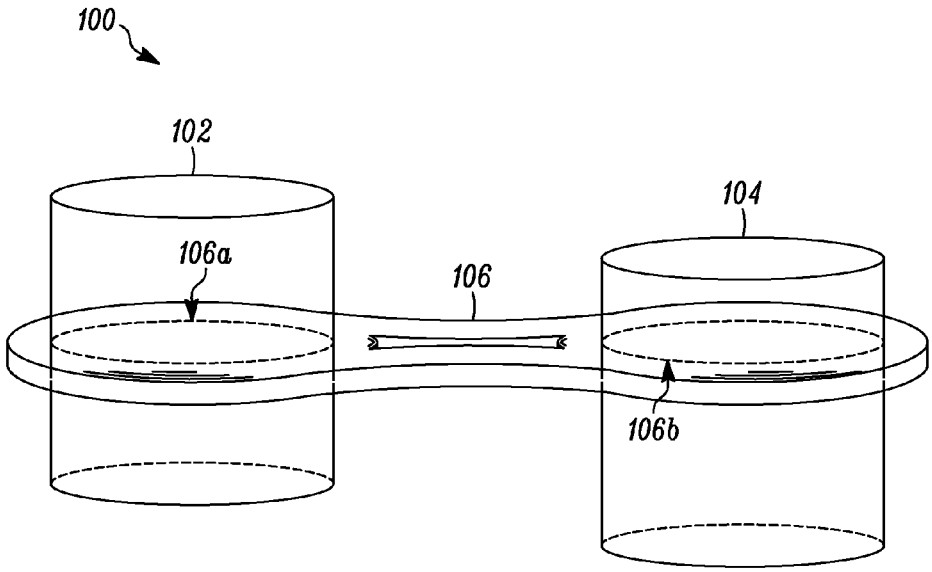
FIG. 1 shows a free standing cup holder according to an embodiment of the present invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION OF THE INVENTION

Before describing in detail the particular device for holding plurality of beverage cups at a time in accordance with an embodiment of the present invention, it should be observed that the present invention resides primarily in combinations of system components related to the device of the present invention.

Accordingly, the system components have been represented where appropriate by conventional symbols in the drawings, showing only those specific details that are pertinent to understanding the present invention so as not to obscure the disclosure with details that will be readily apparent to those of ordinary skill in the art having the benefit of the description herein.

In this document, relational terms such as 'first' and 'second,' and the like, may be used solely to distinguish one entity or action from another entity or action without necessarily requiring or implying any actual such relationship or order between such entities or actions. The terms 'comprises,' 'comprising,' or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by 'comprises . . . a' does not, without more constraints, preclude the existence of additional identical elements in the process, method, article, or apparatus that comprises the element.

FIG. 1 shows a free standing cup holder 100 according to an exemplary embodiment of the present invention. The free standing cup holder 100 includes a first cylinder 102, a second cylinder 104, a connecting member 106, a first circular section 106*a* and a second circular section 106*b*. The first cylinder 102 holds a first cup and is capable of being attached to a permanent cup holder.

According to an embodiment of the present invention, the permanent cup holder comprises a fixed cup holder with a base.

According to an embodiment of the present invention, the first cylinder 102 is wrapped in one of a memory foam and a rubber material to allow snug fit of the first cylinder into the permanent cup holder.

The second cylinder 104 holds a second cup. The connecting member 106 connects the first cylinder 102 and the second cylinder 104.

According to an embodiment of the present invention, the connecting member 106 is manufactured from one of a plastic, a metal, a composite, or any combination thereof.

The connecting member 106 includes the first circular section 106*a* and the second circular section 106*b*. The first circular section 106*a* is molded to the first cylinder 102, and the second circular section 106*b* is molded to the second cylinder 104.

According to an embodiment of the present invention, the first circular section 106*a* is molded to the first cylinder 102 below the center of gravity of the first cylinder 102.

According to another embodiment of the present invention, the second circular section 106*b* is molded to the second cylinder 104 above the center of gravity of the secondary cylinder 104.

According to yet another embodiment of the present invention, the second cylinder 104 comprises a solid base for holding the second cup.

According to a second embodiment of the present invention, the freestanding cup holder 100 is capable of holding a plurality of cups. In the present embodiment, the freestanding cup holder includes a primary cylinder, one or more secondary cylinders and a connecting member. The primary cylinder holds a cup, and is attached to the permanent cup holder. Each of the one or more secondary cylinders is capable of holding a cup. The connecting member connects primary cylinder to the one or more secondary cylinders.

According to one of the embodiment of the second embodiment of the present invention, there are a plurality of connecting members, wherein each of the connecting members of the plurality of connecting members connects the primary cylinder to a corresponding secondary cylinder.

According to yet another embodiment of the second embodiment of the present invention, the primary cylinder is wrapped in one of a memory foam or a rubber material.

According to still another embodiment of the second embodiment of the present invention, the connecting member comprises a primary circular section and one or more secondary circular sections, the primary circular section connected to the one or more secondary circular sections. The primary circular section is molded, or otherwise bonded, to the primary cylinder below center of gravity of the primary cylinder. Each of the one or more secondary circular sections is molded, or otherwise bonded, to a corresponding secondary cylinder of the one or more secondary cylinders above the center of gravity of the corresponding secondary cylinder. Each of the one or more secondary cylinders includes a solid base for holding a cup.

Figure 2:
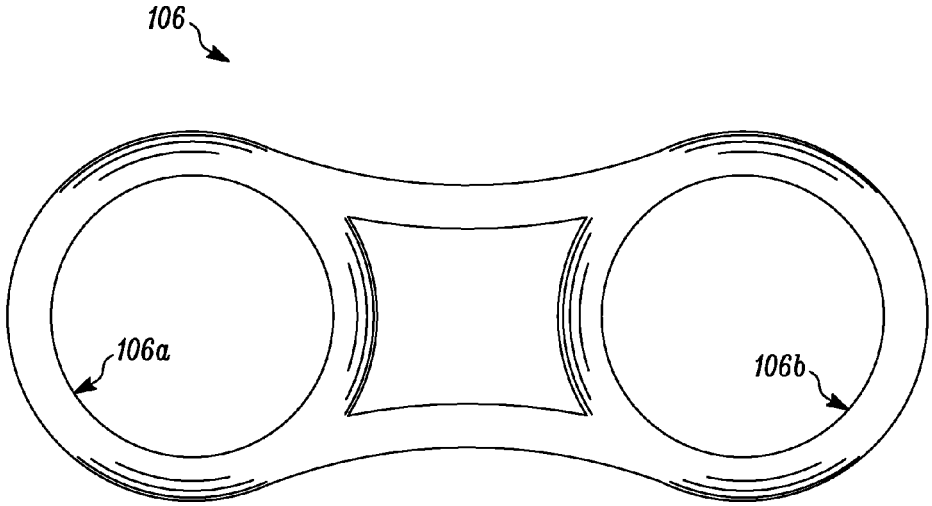
FIG. 2 shows the top view of the connecting member according to an embodiment of the present invention; and, FIG. 3 shows a free standing cup holder in use according to an embodiment of the present invention.

FIG. 2 shows the top view of the connecting member 106 according to an embodiment of the present invention. The connecting member 106 includes the first circular section 106*a* and the second circular section 106*b*. The first circular section 106*a* molded to the first cylinder 102 and the second circular section 106*b* is molded to the second cylinder 104.

According to an embodiment of the present invention, the connecting member 106 is manufactured from one of a plastic, a metal, a composite, or any combination thereof.

Figure 3:
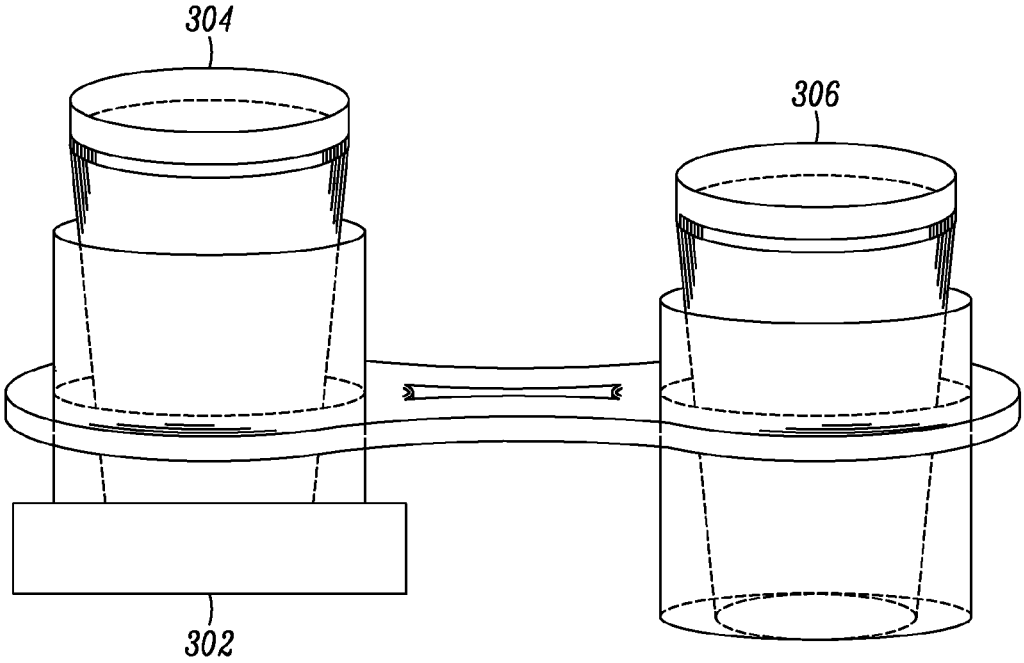

FIG. 3 shows a free standing cup holder 100 in use according to an embodiment of the present invention. The illustration shows a permanent cup holder 302 anchoring the free standing cup holder 100. The illustration further shows a first cup 304 and a second cup 306. The first cup 304 is positioned inside the first cylinder 102. The first cylinder 102 is shown resting in the permanent cup holder 302. The second cup 306 is positioned inside the second cylinder 104. The first cylinder 102 and the second cylinder 104 are connected through the connecting member 106.

The freestanding cup holder as described herein possesses a number of advantages. The device of the present invention facilitates holding of more than one cup in a single cup holder. The freestanding cup holder of the present invention uses an existing cup holder and full beverage to provide storage for more than two cups without the requirement of a fixed base. Further, the freestanding cup holder does not require a clamp, bracket, or other fixture for stability.

While the present invention has been described in connection with preferred embodiments, it will be understood by those skilled in the art that variations and modifications of the preferred embodiments described above may be made without departing from the scope of the invention. Other embodiments will be apparent to those skilled in the art from a consideration of the specification or from a practice of the invention disclosed herein. It is intended that the specification and the described examples are considered exemplary only, with the true scope of the invention indicated by the following claims.

What is claimed is:

1. A freestanding cup holder suitable for holding one or more cups, the freestanding cup holder configured for removable attachment to a fixed cup holder with a base, the freestanding cup holder comprising:

a primary cylinder for holding a cup, the primary cylinder wrapped in one of a memory foam or a rubber material so as to provide for a snug fit of the primary cylinder into the permanent cup holder;

one or more secondary cylinders, each of the one or more secondary cylinders capable of holding a cup; and a connecting member having a primary circular section molded to the primary cylinder below the center of gravity of the primary cylinder, the connecting member further attached to the one or more secondary cylinders.

wherein the connecting member further includes one or more secondary circular sections for attachment to the one or more secondary cylinders, each of the one or more secondary circular sections being molded, or otherwise bonded, to a corresponding secondary cylinder of one or more secondary cylinders above the center of gravity of the corresponding secondary cylinder.

2. A freestanding cup holder comprising:

a primary cylinder wrapped in one of a memory foam or a rubber material so as to provide for a snug fit into a permanent cup holder;

one or more secondary cylinders; and, a connecting member, the connecting member including a primary circular section attached to the primary cylinder and one or more secondary circular sections, each of the one or more secondary circular sections molded to a respective secondary circular cylinder at a point above the center of gravity of the respective secondary circular cylinder;

wherein the primary circular section is molded, or otherwise bonded, to the primary cylinder below the center of gravity of the primary cylinder.

3. A cup holder comprising:

a. a first cylinder configured to hold a first cup, the first cylinder wrapped in one of a memory foam or a rubber material so as to provide for a snug fit of the first cylinder into a permanent cup holder;

b. a second cylinder configured for holding a second cup; and c. a connecting member molded to the first cylinder below the center of gravity of the first cylinder, the connecting member further molded to the second cylinder above the center of gravity of the second cylinder.

4. The cup holder of claim 3, wherein the connecting member comprises at least one of plastic, metal, or composite.

5. The cup holder of claim 3, wherein second cylinder comprises a solid base.

* * * * *